US006208081B1

(12) United States Patent
Eo et al.

(10) Patent No.: US 6,208,081 B1
(45) Date of Patent: Mar. 27, 2001

(54) APPARATUS FOR DRIVING PLASMA DISPLAY PANEL

(75) Inventors: Yoon-phil Eo; Jeong-duk Ryeom, both of Cheonan (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/384,415

(22) Filed: Aug. 27, 1999

(30) Foreign Application Priority Data

Feb. 27, 1999 (KR) ..... 99-6642

(51) Int. Cl.[7] ..... G09G 3/10

(52) U.S. Cl. ..... 315/169.1; 315/169.2; 315/169.4; 345/60

(58) Field of Search ..... 315/169.1, 169.4, 315/169.2; 345/60, 67, 55

(56) References Cited

U.S. PATENT DOCUMENTS 5,446,344 * 8/1995 Kanazawa ..... 315/169.4
5,483,252 * 1/1996 Shigeta ..... 345/67
5,583,527 * 12/1996 Fujisaki et al. ..... 345/55
5,818,419 * 10/1998 Tajima et al. ..... 345/147
5,835,072 * 11/1998 Kanazawa ..... 345/60
5,973,655 * 10/1999 Fujisaki et al. ..... 345/63
6,018,329 * 1/2000 Kita et al. ..... 345/60
6,034,482 * 3/2000 Kanazawa et al. ..... 315/169.4

* cited by examiner

*Primary Examiner*—David Vu
*Assistant Examiner*—Trinh Vo Dinh
(74) *Attorney, Agent, or Firm*—Lowe Hauptman Gopstein Gilman & Berner, LLP

(57) ABSTRACT

An apparatus for driving a plasma display panel in which front and rear substrates face and are spaced apart from each other, common electrode lines, scan electrode lines and address electrode lines are arranged between the front and rear substrates, the common electrode lines are arranged parallel to the scan electrode lines and the address electrode lines are arranged orthogonal to the scan electrode lines to define pixels at intersections thereof, the apparatus including a scan drive part having a memory in which scan data are stored in a predetermined scanning order, for applying a scan drive signal to the scan electrode lines in accordance with scan data corresponding to an input address, an address drive part for applying an address drive signal to the corresponding address electrode lines in accordance with an input display data signal, a common drive part for applying a common drive signal to the common electrode lines in accordance with an input common data signal, and a control part for processing externally input image data and generating the address, the display data signal and the common data signal.

3 Claims, 4 Drawing Sheets

APPARATUS FOR DRIVING PLASMA DISPLAY PANEL

BACKGROUND OF THE INVENTION

1. Field of the Invention

The present invention relates to an apparatus for driving a plasma display panel, and more particularly, to an apparatus for driving a three-electrode surface-discharge alternating-current plasma display panel by an address-while-display driving method.

2. Description of the Related Art

FIG. 1 shows a general three-electrode surface-discharge alternating-current plasma display panel, FIG. 2 is a diagram showing a electrode line pattern of the plasma display panel shown in FIG. 1, and FIG. 3 shows a cell forming a pixel of the plasma display panel shown in FIG. 1. Referring to the drawings, address electrode lines $A_1, A_2, A_3, \ldots, A_{m-2}, A_{m-1}$ and $A_m$, a dielectric layer 11 (and/or 141 of FIG. 3), scan electrode lines $Y_1, Y_2, \ldots, Y_{n-1}$ and $Y_n$, common electrode lines $X_1, X_2, \ldots, X_{n-1}$ and $X_n$ and a MgO protective film 12 are provided between front and rear glass substrates 10 and 13 of a general surface-discharge plasma display panel 1.

The address electrode lines $A_1, A_2, A_3, \ldots, A_{m-2}, A_{m-1}$ and $A_m$, are coated over the entire surface of the rear glass substrate 13 in a predetermined pattern. Phosphors (142 of FIG. 3) may be coated over the entire surface of the scan electrode lines $Y_1, Y_2, \ldots, Y_{n-1}$ and $Y_n$. Otherwise, the phosphors 142 may be coated on the dielectric layer 141 in the event that the dielectric layer is coated over the entire surface of the scan electrode lines $Y_1, Y_2, \ldots, Y_{n-1}$ and $Y_n$ in a predetermined pattern.

The common electrode lines $X_1, X_2, \ldots, X_{n-1}$ and $X_n$ and the scan electrode lines $Y_1, Y_2, \ldots, Y_{n-1}$ and $Y_n$ are arranged on the rear surface of the front glass substrate 10 so as to be orthogonal to the address electrode lines $A_1, A_2, A_3, \ldots, A_{m-2}, A_{m-1}$ and $A_m$ in a predetermined pattern. The respective intersections define corresponding pixels. The common electrode lines $X_1, X_2, \ldots, X_{n-1}$ and $X_n$ and the scan electrode lines $Y_1, Y_2, \ldots, Y_{n-1}$ and $Y_n$ are each comprised of indium tin oxide (ITO) electrode lines $X_{na}$ and $Y_{na}$, and a metal bus electrode lines $X_{nb}$ and $Y_{nb}$, as shown in FIG. 3. The dielectric layer 11 is entirely coated over the rear surface of the common electrode lines $X_1, X_2, \ldots, X_{n-1}$ and $X_n$ and the scan electrode lines $Y_1, Y_2, \ldots, Y_{n-1}$ and $Y_n$. The MgO protective film 12 for protecting the panel 1 against a strong electrical field is entirely coated over the rear surface of the dielectric layer 11. A gas for forming plasma is hermetically sealed in a discharge space.

The driving method generally adopted to the plasma display panel described above is an address/display separation driving method in which a reset step, an address step and a sustain discharge step are sequentially performed in a unit sub-field. In the reset step, wall charges remaining in the previous sub-field are erased. In the address step, the wall charges are formed in a selected pixel area. Also, in the sustain discharge step, light is produced at the pixel at which the wall charges are formed in the address step. In other words, if alternating pulses of a relatively high voltage are applied between the common electrode lines $X_1, X_2, \ldots, X_{n-1}$ and $X_n$ and the scan electrode lines $Y_1, Y_2, \ldots, Y_{n-1}$ and $Y_n$, a surface discharge occurs at the pixel at which the wall charges are formed. Here, plasma is formed at the gas layer of the discharge space 14 and the phosphors 142 are excited by ultraviolet rays to thus emit light.

Here, several unit sub-fields basically operating in the principles as described above are contained in a unit frame, thereby achieving a desired gray scale display by sustain discharge time intervals of the respective sub-fields.

Typical examples of such driving methods are an address/display separation driving method and an address-while-display driving method.

According to the address/display separation driving method, in a unit sub-field set for gray scale display, an address period and a sustain discharge period are separated. Accordingly, it is easy to design and change a driving apparatus and the driving apparatus is simplified. However, the sustain discharge period is relatively short, which lowers display luminance.

On the other hand, according to the address-while-display driving method, an address period is contained within a display period of each sub-field, the respective sub-fields start with a difference of a unit time with respect to the respective scan electrode lines so as to be overlapped. Here, the unit time refers to a minimum driving period for gray scale display and equals to a value obtained by dividing a unit frame by the number of gray scales to be displayed. Accordingly, the sustain discharge period is relatively longer, thereby increasing display luminance. However, since a scanning operation cannot be sequentially performed in an arrangement order of the scan electrode lines $Y_1, Y_2, \ldots, Y_{n-1}$ and $Y_n$, it is difficult to design the circuitry of a scan drive part of the driving apparatus.

In the conventional driving apparatus for driving a plasma display panel by the address-while-display driving method, the scan drive part applies a scan drive signal to a scan electrode line $Y_1, Y_2, \ldots, Y_{n-1}$ or $Y_n$ corresponding to a set scanning order using only a serial-in/parallel-out shift register having as many output ports as the scan electrode lines $Y_1, Y_2, \ldots, Y_{n-1}$ and $Y_n$. For example, in order to apply the scan drive signal to the $129^{th}$ scan electrode line $Y_{129}$ after the scan drive signal is applied to the first scan electrode line $Y_1, Y_2, \ldots, Y_{n-1}$ or $Y_n$, 129 shift clock pulses must be generated.

Accordingly, the above-described conventional driving apparatus has the following problems.

First, a standby time ranging from the time of applying a scan drive signal to a scan electrode line to the time of applying the scan drive signal to another scan electrode line for performing address-while-display driving is comparatively long. Accordingly, the address period is increased and the sustain discharge period is shortened, which lowers display luminance.

Second, in the case of a high resolution plasma display panel, that is, a plasma display panel having many scan electrode lines, frequencies of clock pulses must be relatively high. Accordingly, the driving apparatus operates unstably and a picture quality is deteriorated. Also, it is difficult to design and fabricate the driving apparatus.

SUMMARY OF THE INVENTION

To solve the above problem, it is an objective of the present invention to provide a driving apparatus for driving a plasma display panel by an address-while-display driving method, which can increase display luminance and picture quality, operate stably and facilitates design and fabrication of the same.

Accordingly, to achieve the above objective, there is provided an apparatus for driving a plasma display panel in which front and rear substrates face and are spaced apart from each other, common electrode lines, scan electrode lines and address electrode lines are arranged between the front and rear substrates, the common electrode lines are arranged parallel to the scan electrode lines and the address electrode lines are arranged orthogonal to the scan electrode lines to define pixels at intersections thereof, the apparatus including a scan drive part having a memory in which scan data are stored in a predetermined scanning order, for applying a scan drive signal to the scan electrode lines in accordance with scan data corresponding to an input address, an address drive part for applying an address drive signal to the corresponding address electrode lines in accordance with an input display data signal, a common drive part for applying a common drive signal to the common electrode lines in accordance with an input common data signal, and a control part for processing externally input image data and generating the address, the display data signal and the common data signal.

The scan drive part includes a memory in which scan data are stored in a predetermined scanning order and the scan drive signal is applied to the scan electrode lines in accordance with the scan data corresponding to the input address. Therefore, the following effects are realized.

First, a standby time ranging from the time of applying a scan drive signal to a scan electrode line to the time of applying the scan drive signal to another scan electrode line for performing address-while-display driving becomes comparatively shorter. Accordingly, the address period is decreased and the sustain discharge period is prolonged, which enhances display luminance.

Second, in the case of a high resolution plasma display panel, that is, a plasma display panel having many scan electrode lines, frequencies of clock pulses are not necessarily relatively high. Accordingly, the driving apparatus can operate stably and a picture quality is improved. Also, it is easy to design and fabricate the driving apparatus.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

Figure 4:
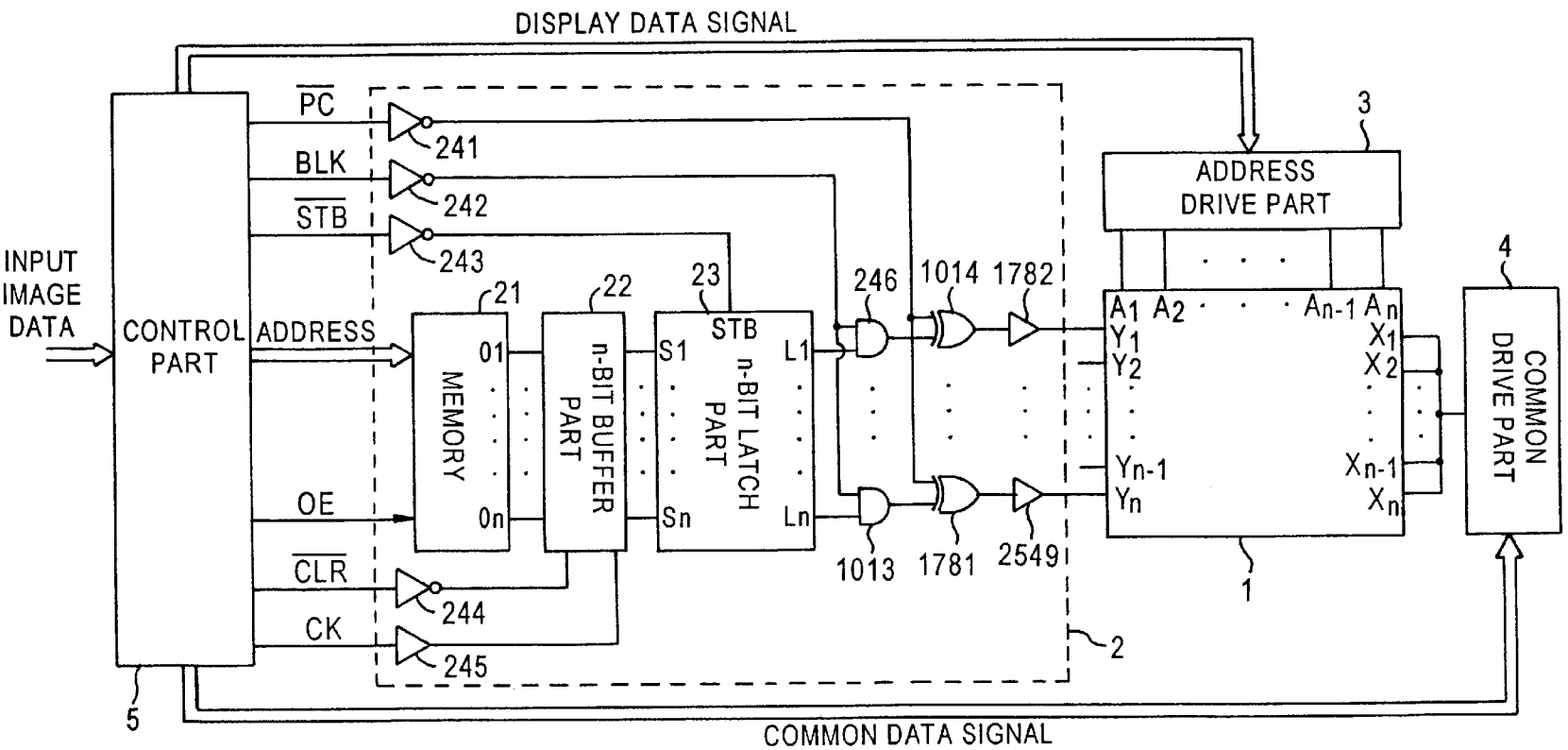
FIG. 4 is a block diagram of an apparatus for driving a plasma display panel according to a first embodiment of the present invention.

Referring to FIG. 4, a driving apparatus of a plasma display panel 1 according to a first embodiment of the present invention includes a scan drive part 2, an address drive part 3, a common drive part 4 and a control part 5. The scan drive part 2 including a memory 21 in which scan data are stored in a predetermined scanning order applies a scan drive signal to scan electrode lines $Y_1, Y_2, \ldots, Y_{n-1}$ and $Y_n$ in accordance with the scan data corresponding to an input address. The address drive part 3 applies an address drive signal to the corresponding address electrode lines $A_1, A_2, A_3, \ldots, A_{m-2}, A_{m-1}$ and $A_m$ in accordance with an input display data signal. The common drive part 4 applies a common drive signal to the common electrode lines $X_1, X_2, \ldots, X_{n-1}$ and $X_n$ in accordance with an input common data signal. The control part 5 processes an externally input image data and generates the address, the display data signal and the common data signal.

The scan drive part 2 includes a n-bit buffer part 22, a n-bit latch part 23 and gate elements 241 to 2549, in addition to the memory 21. Here, for implementation of address-while-display driving, assuming that the number of gray scales is p, the number of sub-fields in a unit frame is SF and the number of scan electrode lines is n, the capacity q of the memory 21 is set by the following equation (1):

$$q=p\times SF\times n$$

For example, when n=256, SF=8 and n=768, the capacity q of the memory 21 is 1,572,865 bits, which is not so large.

If an address and an output enable signal OE are input to the memory 21 from the controller 5, the corresponding scan data is output through an n-bit output port [O1, . . . , On]. The scan data is input to the p-bit buffer part 22 and then input to input ports S1 to Sn of the n-bit latch part 23 by a clear signal $\overline{CLR}$ and a clock signal CK input from the control part 5 through an inverter 244 and a buffer 245.

The scan data input to the n-bit latch part 23 is input to one input port of the respective AND gates 246, . . . , 1013 in accordance with a strobe signal $\overline{STB}$ input from the control part 5 through an inverter 243. The scan data input to first input ports of the respective AND gates 246, . . . and 1013 is input to first input ports of the respective XOR gates 1014, . . . and 1781 in accordance with a blanking signal BLK input from the control part 5 to second input ports of the respective AND gates 246, . . . and 1013 through an inverter 242.

The scan data input to first input ports of the respective XOR gates 1014, . . . and 1781 is input to the respective buffers 1782, . . . and 2549 in accordance with a phase control signal $\overline{PC}$ input from the control part 5 to second input ports of the respective XOR gates 1014, . . . and 1781 through an inverter 241. The respective buffers 1782, . . . and 2549 apply scan drive signals corresponding to the input scan data to the scan electrode lines $Y_1, Y_2, \ldots, Y_{n-1}$ and $Y_n$.

Figure 5:
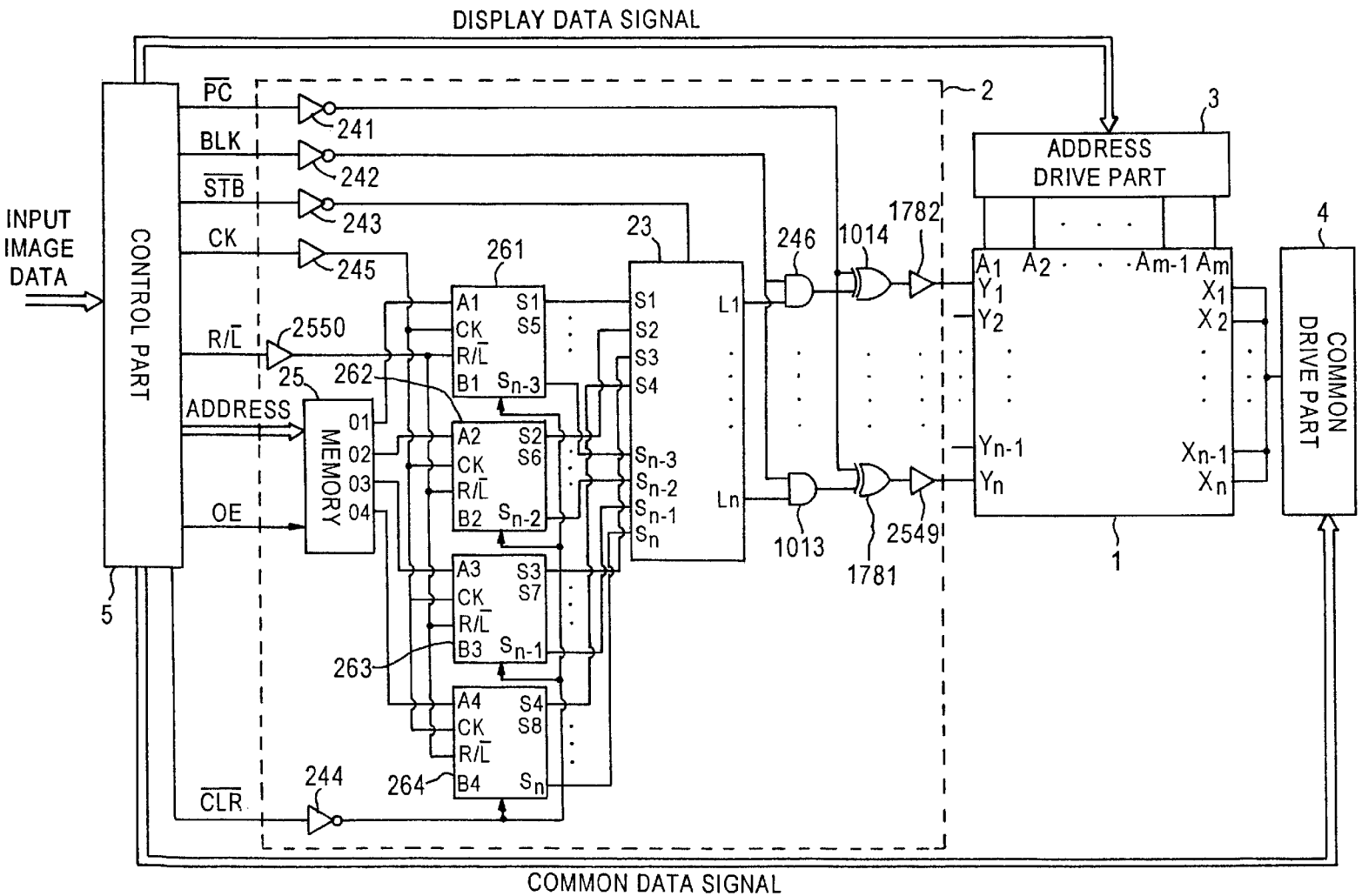
FIG. 5 is a block diagram of an apparatus for driving a plasma display panel according to a second embodiment of the present invention.

Referring to FIG. 5, the driving apparatus of the plasma display panel according to a second embodiment of the present invention includes a scan drive part 2, an address drive part 3, a common drive part 4 and a control part 5. In FIG. 5, the same reference numerals as those of FIG. 4 denote the same functional elements.

Here, the number N (Dout) of data output ports O1, O2, O3 and O4 of the memory 25 of the scan drive part 2 is four and is set as a divisor of the number n of the scan electrode lines $Y_1, Y_2, \ldots, Y_{n-1}$ and $Y_n$. Also, in the scan drive part 2, four serial-in/parallel-out shift registers 261, 262, 263 and 264, that is, as many as the data output ports of the memory 25 of the scan drive part 2, are provided. The data output ports O1, O2, O3 and O4 of the memory 25 are connected to serial input port A1, A2, A3 and A4 of the corresponding shift registers 261, 262, 263 and 274, respectively. The number N (Qout) of output ports O1, O2, O3 and O4 of the respective shift registers 261, 262, 273 and 264 corresponds to a quotient, i.e., n/4, obtained by dividing the number n of the scan electrode lines $Y_1, Y_2, \ldots, Y_{n-1}$ and $Y_n$ by the number of the data output ports O1, O2, O3 and O4 of the memory 25, i.e. 4.

A signal R/$\overline{L}$ input from the control part 5 to the respective shift registers 261, 262, 263 and 264 through a buffer 2550 serves to process signals input to first input ports A1 of the respective shift registers 261, 262, 263 and 264. The scan data input to the respective shift registers 261, 262, 263 and 264 are output through output ports selected by the number of input pulses to clock ports CK of the respective shift registers 261, 262, 263 and 264.

Figure 1:
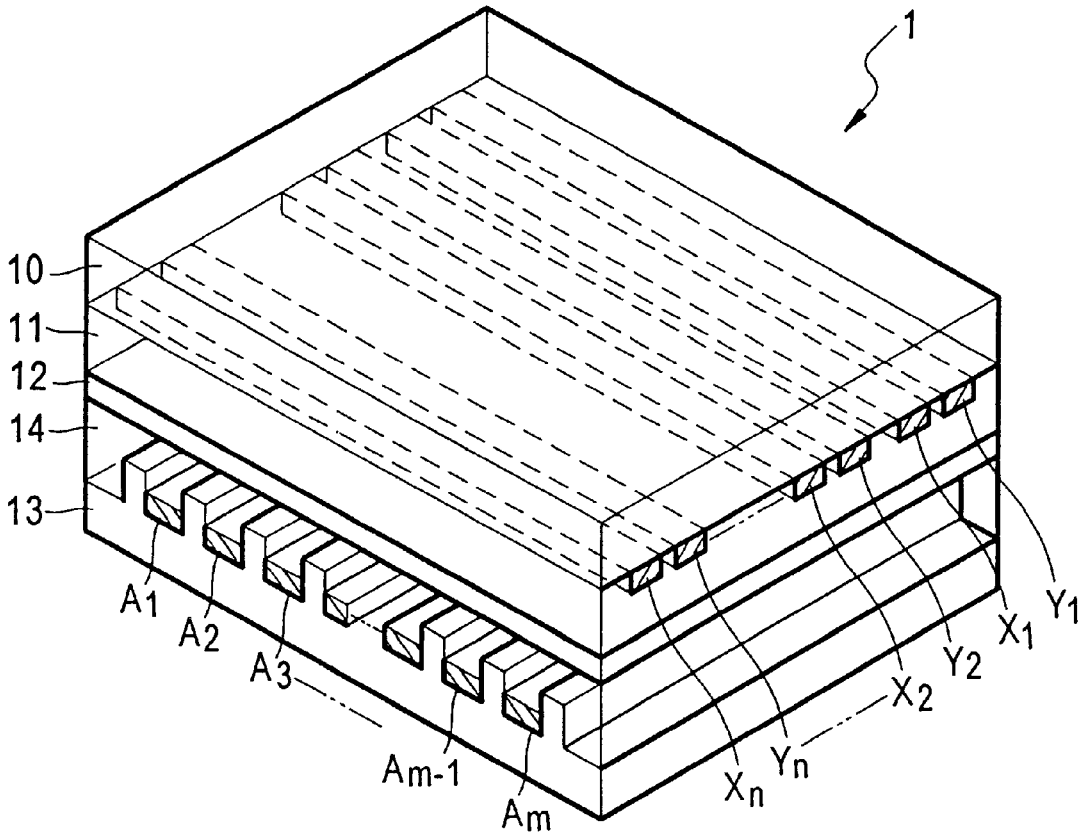
FIG. 1 shows the structure of a three-electrode surface-discharge alternating-current general plasma display panel.
Figure 2:
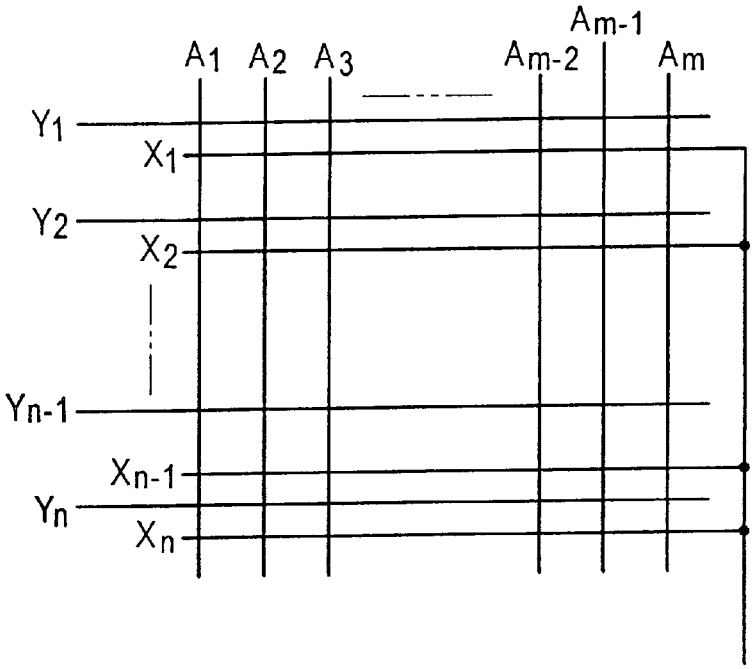
FIG. 2 is an electrode line pattern diagram of the plasma display panel shown in FIG. 1.
Figure 3:
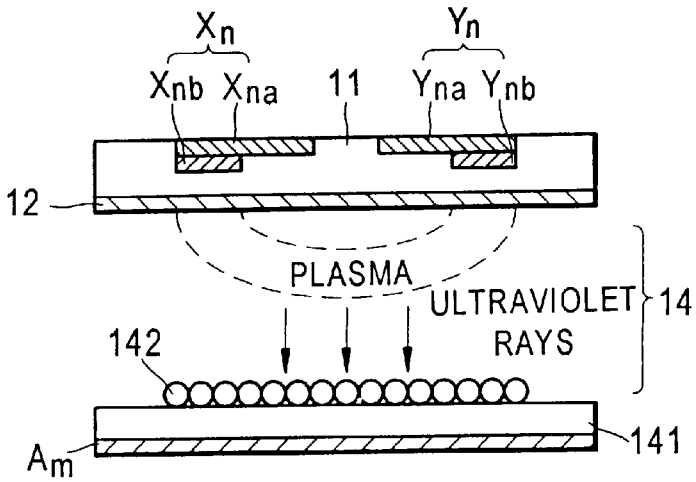
FIG. 3 is a cross-sectional view of a cell forming a pixel of the plasma display panel shown in FIG. 1.

The scan data output through the corresponding output ports of the respective shift registers 261, 262, 263 and 264 are input to the n-bit latch part 23 based on the operational principle described in FIG. 3 and are applied to the corresponding scan electrode lines $Y_1$, $Y_2$, . . . , $Y_{n-1}$ and $Y_n$ as scan drive signals through the AND gates 246, . . . and 1013, the XOR gates 1014, . . . and 1781 and the buffers 1782, . . . and 2549.

As described above, in the apparatus for driving the plasma display panel according to the present invention, since the scan drive part includes a memory in which scan data are stored in a predetermined scanning order and the scan drive signal is applied to the scan electrode lines in accordance with the scan data corresponding to the input address, the following effects are realized.

First, a standby time ranging from the time of applying a scan drive signal to a scan electrode line to the time of applying the scan drive signal to another scan electrode line for performing address-while-display driving becomes comparatively shorter. Accordingly, the address period is decreased and the sustain discharge period is prolonged, which enhances display luminance.

Second, in the case of a high resolution plasma display panel, that is, a plasma display panel having many scan electrode lines, frequencies of clock pulses are not necessarily relatively high. Accordingly, the driving apparatus can operate stably and a picture quality is improved. Also, it is easy to design and fabricate the driving apparatus.

Although the invention has been described with respect to a preferred embodiment, it is not to be so limited as changes and modifications can be made which are within the full intended scope of the invention as defined by the appended claims.

What is claimed is:

1. An apparatus for driving a plasma display panel in which front and rear substrates face and are spaced apart from each other, common electrode lines, scan electrode lines and address electrode lines are arranged between the front and rear substrates, the common electrode lines are arranged parallel to the scan electrode lines and the address electrode lines are arranged orthogonal to the scan electrode lines to define pixels at intersections thereof, the apparatus comprising:

a scan drive part having a memory in which scan data are stored in a predetermined scanning order for applying a scan drive signal to the scan electrode lines in accordance with scan data corresponding to an input address;

an address drive part for applying an address drive signal to the corresponding address electrode lines in accordance with an input display data signal;

a common drive part for applying a common drive signal to the common electrode lines in accordance with an input common data signal; and a control part for processing externally input image data and generating the address, the display data signal and the common data signal, wherein the number of data output ports of the memory of the scan drive part corresponds to a divisor of the number of the scan electrode lines, as many serial-in/parallel-out shift registers as the data output ports of the memory of the scan drive part are provided in the scan drive part, the data output ports of the memory are connected to serial input ports of the corresponding shift registers, respectively, the number of output ports of the respective shift registers corresponds to a quotient obtained by dividing the number of the scan electrode lines by the number of the data output ports of the memory, the scan data input to the respective shift registers are output through output ports selected by the number of input pulses to clock ports of the respective shift registers, the scan data output through the corresponding output ports of the respective shift registers are applied to the corresponding scan electrode lines as scan drive signals.

2. An apparatus for driving a plasma display panel in which front and rear substrates face and are spaced apart from each other, common electrode lines, scan electrode lines and address electrode lines are arranged between the front and rear substrates, the common electrode lines are arranged parallel to the scan electrode lines and the address electrode lines are arranged orthogonal to the scan electrode lines to define pixels at intersections thereof, the apparatus comprising:

a scan drive part having a latch part coupled to a memory in which scan data are stored in a predetermined scanning order, for applying a scan drive signal to the scan electrode lines in accordance with scan data corresponding to an input address;

an address drive part for applying an address drive signal to the corresponding address electrode lines in accordance with an input display data signal;

a common drive part for applying a common drive signal to the common electrode lines in accordance with an input common data signal; and a control part for processing externally input image data and generating the address, the display data signal and the common data signal.

3. The apparatus according to claim 2, wherein the number of data output ports of the memory of the scan drive part is the same as that of the scan electrode lines.

* * * * *